US006254224B1

(12) United States Patent
Tomlin et al.

(10) Patent No.: US 6,254,224 B1
(45) Date of Patent: Jul. 3, 2001

(54) INK JET PRINTER

(75) Inventors: Matthew Tomlin; Ammar Lecheheb, both of Cambridge (GB)

(73) Assignee: Domino Printing Sciences Plc (GB)

( * ) Notice: Subject to any disclaimer, the term of this patent is extended or adjusted under 35 U.S.C. 154(b) by 0 days.

(21) Appl. No.: 09/331,567

(22) PCT Filed: Dec. 18, 1997

(86) PCT No.: PCT/GB97/03482

§ 371 Date: Aug. 20, 1999

§ 102(e) Date: Aug. 20, 1999

(87) PCT Pub. No.: WO98/28143

PCT Pub. Date: Jul. 2, 1998

(30) Foreign Application Priority Data

Dec. 23, 1996 (GB) ..... 9626705

(51) Int. Cl.[7] ..... B41J 2/025; B41J 2/02

(52) U.S. Cl. ..... 347/75

(58) Field of Search ..... 347/73–75, 68, 347/70, 72, 54, 48, 44, 20; 29/890.01; 239/4, 102.1

(56) References Cited

U.S. PATENT DOCUMENTS

| | | | | |
|---|---|---|---|---|
| 4,095,232 | * | 6/1978 | Cha | 347/75 |
| 4,138,687 | * | 2/1979 | Cha et al. | 347/75 |
| 4,324,117 | * | 4/1982 | Schwob et al. | 68/205 R |
| 4,528,571 | * | 7/1985 | Sweet | 347/75 |
| 5,502,473 | * | 3/1996 | East et al. | 347/73 |
| 5,912,686 | * | 6/1999 | Palmer et al. | 347/75 |

FOREIGN PATENT DOCUMENTS

| | | | | |
|---|---|---|---|---|
| 0 709 194A1 | * | 5/1996 | (EP) | B41J/2/025 |
| WO 96/12622 | * | 5/1996 | (WO) | B41J/2/025 |

* cited by examiner

*Primary Examiner*—Huan Tran
(74) *Attorney, Agent, or Firm*—Robert F. I. Conte; Lee, Mann, Smith, McWilliams, Sweeney & Ohlson

(57) ABSTRACT

A droplet generator for a multi-jet CIJ printhead that has an ink chamber with plural orifices for the emission of fluid streams. An actuator drive armature is disposed within the ink chamber and, at one side, has a one-piece solid drive wall with a pair of major faces which are tapered towards one another in the direction away from the other side. At the other side there is only a single pair of transducer mountings disposed adjacent the ends of the drive wall.

18 Claims, 2 Drawing Sheets

Fig. 1
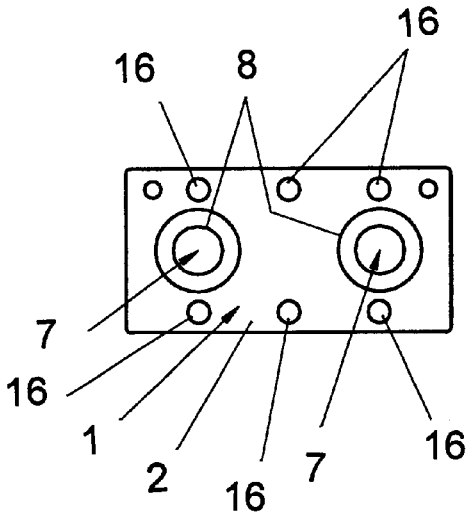
Fig. 2
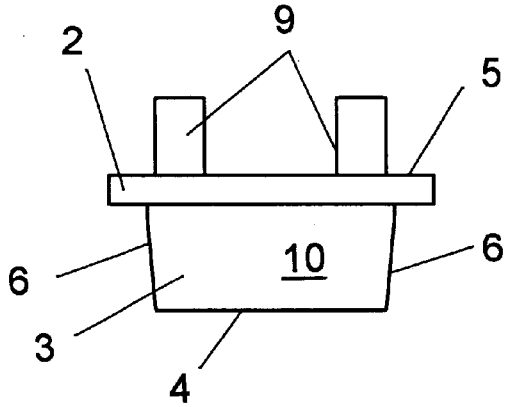
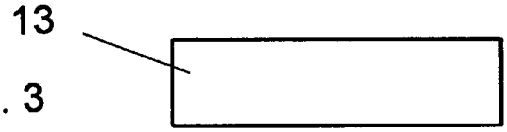
Fig. 3
Fig. 4
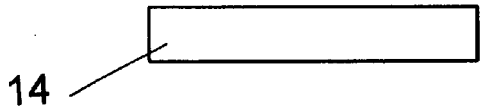

INK JET PRINTER

FIELD OF THE INVENTION

The present invention relates to ink jet printers and, more particularly, to an actuator drive for a multi-jet continuous ink jet (CIJ) printer.

BACKGROUND OF THE INVENTION

In a multi-jet continuous ink jet printer, in order to create streams of droplets issuing through multiple nozzles or orifices, it is known to pressure modulate the fluid by means of plural piezoelectrically actuated drive rods or else by a single piezoelectrically actuated armature. A problem associated with plural drive rods is the need to ensure syncronicity between the independent drive rods so that they are all vibrating in phase. A problem with a single armature causing jets to issue through a row of orifices is that of preventing transverse flexure and nonuniformity of pressure changes across the row of orifices.

It is also known, in a multi-jet continuous inkjet printer, to create streams of droplets by means of the velocity modulator or resonator as shown in U.S. Pat. No. 4,999,647. In U.S. Pat. No. 4,999,647 a resonator is shown with elongate slots disposed between transducers mounted within the resonator and an ink passage passes through the resonator and communicates with orifices in an orifice plate bonded to one side of the resonator. In WO-A-96-12622we describe a multi-jet continuous ink jet printhead having an ink chamber, the chamber having a plurality of orifices for the emission of fluid droplets therefrom, and an actuator drive armature with a plurality of elongate slots therethrough disposed in a row, characterised in that the armature is disposed within the ink chamber, and has a row of transducer mountings at one side and a drive wall at the other side, the slots being disposed in the drive wall in a row parallel-to the one side of the armature, and each slot extending away from the one side and being aligned intermediate the transducer mountings, whereby lands between the slots are aligned with the transducer mountings.

SUMMARY OF THE INVENTION

According to a first aspect of the present invention there is provided a multi-jet continuous ink jet printhead droplet generator having an ink chamber, the chamber having a plurality of orifices for the emission of fluid droplets therefrom, and an actuator drive armature disposed within the ink chamber, the actuator drive armature having a one piece solid drive wall at one side and a single pair of transducer mountings at the other side, the transducer mountings being disposed adjacent respective ends of the drive wall.

With a one-piece, ie non-split drive wall, fabrication is simpler and the same benefit is provided by having only a single pair of transducer mountings. It has been found in practice that having the transducers mounted adjacent the ends of the drive wall, as opposed to being equidistantly arranged over the length of the drive wall, provides an improved drive wall response.

The drive wall may have a pair of major faces which are tapered towards one another in the direction away from the other side.

Tapering the major faces towards one another results in a gradual narrowing of the drive wall which, in turn, causes it to act as a velocity transformer, increasing the efficiency of the energy transfer from the actuator transducer(s) disposed at the other side of the actuator drive armature.

The tapered major faces may be produced by a machining method which machines the faces continuously, in which case, the minor or end faces of the drive wall my also be tapered towards one another.

BRIEF DESCRIPTION OF THE DRAWINGS

One example of a droplet generator according to the present invention will now be described with reference to the accompanying drawings in which:

FIG. 1 is a plan view of the droplet generator;

FIG. 2 is a side view of the actuator drive armature;

FIG. 3 is a side view of the body on which the armature is fixed;

FIG. 4 is a side view of a nozzle plate of the droplet generator; and,

DETAILED DESCRIPTION OF THE INVENTION

Figure 5:
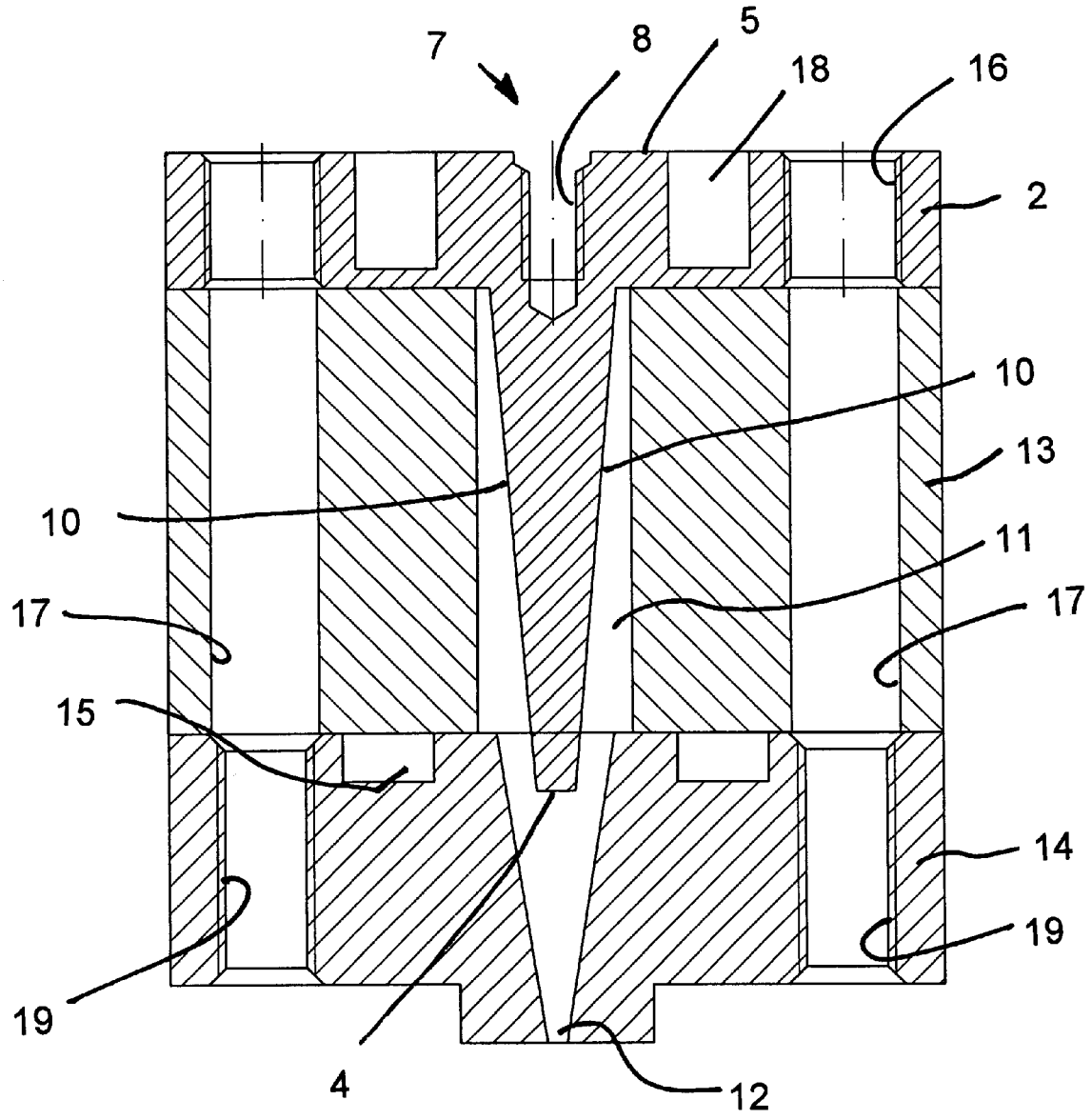
FIG. 5 is a cross-section through the assembly droplet generator.

In the droplet generator of this example, the actuator drive armature 1 comprises a stainless steel member having a mounting flange 2 by means of which the armature is secured within an ink chamber 11 defined by a body 13 and an orifice or nozzle plate 14.

Extending perpendicularly away from the flange 2 on one side is a one-piece solid drive wall 3 which has a lower surface 4 which, in use, is disposed above orifices 12 in the nozzle plate 14 from which ink is ejected from the ink chamber 11. The major side faces 10 of the drive wall 3 are tapered towards one another (as seen best in FIG. 5) from top to bottom at an angle of 5° to the central axial plane of the drive wall. The minor end faces 6 are also tapered towards one another as a result of the machining process used to shape the major side faces 10.

The top 5 of the mounting flange 2 is formed, at positions adjacent the respective ends 6 of the drive wall 3, with a pair of transducer mountings 7, each of which has a central threaded bore 8 and surrounding annular groove 18 by means of which a single pair of piezoelectric transducers 9 can be mounted onto the armature in order to cause it to vibrate in use. Bores 16 are also provided to enable mounting bolts to be fitted through the flange 2. The bores are provided at three positions along the length of the mounting flange 2, in alignment with the transducer mountings 7 at each end and centrally (equidistant the transducer mountings 7). This improves the uniformity of energy transfer from the transducers 9 to the drive wall 3.

Metal-to-metal contact between the drive armature 1, the nozzle plate 14, and the body 13 is reduced by providing O-rings (not shown) surrounding the ink chamber 11 on the top and bottom faces of the body 13 or on the opposing faces of the mounting plate 2 and/or the nozzle plate 14. FIG. 5 shows an annular groove 15 in which a suitable O-ring seal can seat.

The body 13 has bores 17 aligned with the bores 16 in the mounting flange 2 and with corresponding bores 19 in the nozzles plate 14, by means which and through the use of bolts inserted into the respective bores, the components can be securely held together.

What is claimed is:

1. A droplet generator for a multi jet continuous inkjet printer, comprising:

an ink chamber, said ink chamber having a plurality of orifices for an emission of fluid droplets therefrom, an actuator drive armature disposed within the ink chamber, the actuator drive armature having a one-piece solid drive wall at one side and only a single pair of transducer mountings at the other side, the transducer mountings being disposed adjacent respective ends of the drive wall.

2. A droplet generator according to claim 1, wherein the ink chamber has a body; and the actuator armature has a flange by means of which it is mounted on one side of the ink chamber body, the flange having three holes on each side, a first hole aligned centrally along the flange, and second and third holes disposed in alignment with respective transducer mountings, and including bolts, for fixing the armature to the body, through each of the holes.

3. A droplet generator according to claim 1, wherein the drive wall has a pair of major faces which are tapered towards one another in the direction away from the other side.

4. A droplet generator according to claim 2, wherein the drive wall has a pair of major faces which are tapered towards one another in the direction away from the other side and when in the ink chamber, the ink chamber has a smaller cross-section adjacent said one side of the ink chamber bodes than a cross-section adjacent an opposite side of the ink chamber body.

5. A droplet generator according to claim 3, wherein the drive wall has a pair of minor faces which are tapered towards one another in the direction away from the other side.

6. A droplet generator according to claim 4, wherein the drive wall has a pair of minor faces which are tapered towards one another in the direction away from the other side.

7. A continuous ink-jet printer printhead having a droplet generator an ink chamber, said ink chamber having a plurality of orifices for an emission of fluid droplets therefrom, an actuator drive armature disposed within the ink chamber, the actuator drive armature having a one-piece solid drive wall at one side and only a single pair of transducer mountings at the other side, the transducer mountings being disposed adjacent respective ends of the drive wall.

8. The continuous ink-jet printer printhead of claim 7 wherein the ink chamber has a body; and the actuator armature has a flange by means of which it is mounted on one side of the ink chamber body; the flange having three holes on each side, a first hole aligned centrally along the flange, and second and third holes disposed in alignment with respective transducer mountings, and including bolts, for fixing the armature to the body through each of the holes.

9. The continuous ink-jet printer printhead of claim 7 wherein the drive wall has a pair of major faces which are tapered towards one another in the direction away from the other side.

10. The continuous ink-jet printer printhead of claim 7 wherein the drive wall has a pair of major faces which are tapered towards one another in the direction away from the other side and when in the ink chamber, the ink chamber has a cross-section adjacent said one side of the ink chamber body there adjacent an opposite side of the ink chamber body.

11. The continuous ink-jet printer printhead of claim 7 wherein the drive wall has a pair of minor faces which are tapered towards one another in the direction away from the other side.

12. The continuous ink-jet printer printhead of claim 7 wherein the drive wall has a pair of minor faces which are tapered towards one another in the direction away from the other side.

13. A continuous ink-jet printer having printhead comprising:

an ink chamber, said ink chamber having a plurality of orifices for an emission of fluid droplets therefrom, an actuator drive armature disposed within the ink chamber, the actuator drive armature having a one-piece solid drive wall at one side and only a single pair of transducer mountings at the other side, the transducer mountings being disposed adjacent respective ends of the drive wall.

14. The continuous ink-jet printer of claim 13 wherein the ink chamber has a body; and the actuator armature has a flange by means of which it is mounted on one side of the ink chamber body; the flange having three holes on each side, a first hole aligned centrally along the flange and second and third holes disposed in alignment with respective transducer mountings, and including bolts, for fixing the armature to the body, through each of the holes.

15. The continuous ink-jet printer of claim 13 wherein the drive wall has a pair of major faces which are tapered towards one another in the direction away from the other side.

16. The continuous ink-jet printer of claim 13 wherein the drive wall has a pair of major faces which are tapered towards one another in the direction away from the other side and when in the ink chamber, the ink chamber has a cross-section adjacent said one side of the ink chamber body there adjacent an opposite side of the ink chamber body.

17. The continuous ink-jet printer of claim 13 wherein the drive wall has a pair of minor faces which are tapered towards one another in the direction away from the other side.

18. The continuous ink-jet printer of claim 13 wherein the drive wall has a pair of minor faces which are tapered towards one another in the direction away from the other side.

* * * * *